US006004012A

United States Patent [19]

Hsieh

[11] Patent Number: 6,004,012

[45] Date of Patent: Dec. 21, 1999

[54] LIGHTING FITTING

[75] Inventor: Duan-Cheng Hsieh, Taipei, Taiwan

[73] Assignee: Habitax Corporation, Taipei, Taiwan

[21] Appl. No.: 09/042,212

[22] Filed: Mar. 13, 1998

[51] Int. Cl.[6] ..... F21V 7/00; F21V 19/00

[52] U.S. Cl. ..... 362/454; 362/249; 362/408

[58] Field of Search ..... 362/227, 404, 362/408, 249, 457

[56] References Cited

U.S. PATENT DOCUMENTS

| | | | |
|---|---|---|---|
| 1,484,978 | 2/1924 | Wheeler | 362/249 X |
| 2,914,661 | 11/1959 | Winkler | 362/408 X |
| 4,118,764 | 10/1978 | Bleiweiss et al. | 362/249 X |
| 4,300,190 | 11/1981 | Mershon | 362/404 |
| 4,356,540 | 10/1982 | Goralnik | 362/249 X |
| 4,956,758 | 9/1990 | Aubrey et al. | 362/457 X |
| 5,174,648 | 12/1992 | Clary et al. | 362/404 X |

*Primary Examiner*—Laura K. Tso
*Attorney, Agent, or Firm*—Skjerven, Morrill, MacPherson, Franklin & Friel LLP; Alan H. MacPherson

[57] ABSTRACT

A light fitting includes a containment member, a mounting bracket, a pair of socket members, and a lampshade body. The containment member includes an upper body with a bottom wall, and an annular portion that extends divergently from the bottom wall. The bracket member includes a middle portion that has an elongate middle portion for securing to the bottom wall, and a bottom wide surface and a top wide surface, and first and second end portion which are disposed at opposite sides of the middle portion. The first and second end portions are bent respectively to an acute angle relative to and towards the bottom wide surface of the middle portion along two parallel lines which incline with a predetermined angle relative to a perpendicular line that crosses a longitudinal direction of the middle portion so as to form first and second anchoring surfaces, respectively. The socket members are mounted on the anchoring surfaces to receive a pair of incandescent bulbs. The lampshade body is formed from molding plastics, and includes an upper wall and a skirt portion which extends downwardly and divergently from the periphery confining the upper wall. The upper wall is mounted detachably to the bottom wall and has a through hole to expose the bracket member therefrom.

4 Claims, 3 Drawing Sheets

LIGHTING FITTING

BACKGROUND OF THE INVENTION

1. Field of the Invention

The invention relates to a light fitting, more particularly to a light fitting for an incandescent lighting arrangement which has a pair of incandescent bulbs.

2. Description of the Related Art

A conventional light fitting includes a lampshade body of molding plastics, amounting bracket, a socket member, a pair of insulated conductive cord members, a containment member, a power cord member and an incandescent bulb. The incandescent bulb has a bulb body and a bulb base. The lampshade body has an upper wall with a through hole formed therethrough, and a skirt portion which extends downwardly and divergently from the periphery confining the upper wall. The mounting bracket is fixed to the upper wall, and has a mounting hole aligned with the through hole of the upper wall, and a mounting face distal relative to the upper wall. The socket member has a shell portion to receive the bulb base, and a seat portion which extends from the shell portion in an axial direction and which is disposed perpendicularly to abut against the mounting face of the bracket member. The insulated conductive cord members have first ends connected conductively to the seat portion of the socket member and second ends that extend through the mounting hole of the bracket member and the through hole of the upper wall to form a first contact terminal. The second ends of the insulated cord members are disposed outwardly and upwardly relative to the lampshade body. The containment member is capable of housing electrical components associated with the electricity supply to the incandescent lighting arrangement, and includes a circumferential wall superimposed upon the upper wall of the lampshade body when the containment member is coupled with the lampshade body. The power cord member is adapted to be connected to a power source, and is led downwardly and outwardly of the circumferential wall of the containment member to form a second contact terminal for coupling conductively with the first contact terminal.

Note that the incandescent bulb extends downwardly and vertically relative to the bracket member in the conventional light fitting. The lighting effect provided thereby is inferior to a halogen lamp which has the same wattage as the incandescent bulb, thereby resulting in discomfort to a user who is accustomed to the lighting arrangement of the halogen lamp. In addition, the conventional light fitting is bulky and therefore occupies a relatively large amount of space during storage and transport. Even though the lampshade body can be detached from the containment member, the lampshade bodies of the several light fittings cannot be stacked over each other due to the presence of the mounting bracket, the socket member and the incandescent bulb in the upper wall.

In a co-pending U.S. application Ser. No. 09/012,362, entitled "LIGHT FITTING FOR AN INCANDESCENT LIGHTING ARRANGEMENT", filed on Jan. 23, 1998 by the applicant, there is disclosed a light fitting including a lampshade body, a mounting bracket, a pair of socket members, a pair of insulated conductive cord members, a containment member, a pair of incandescent bulbs, and a power cord member.

SUMMARY OF THE INVENTION

Therefore, the object of this invention is to provide a light fitting for an incandescent lighting arrangement. The light fitting includes a pair of incandescent bulbs that can provide a lighting effect comparable to that of a halogen lamp which has the same wattage as the incandescent bulbs, and a lampshade body that can be easily detached from a containment member such that a plurality of the lampshade bodies can be stacked one over another to facilitate storage and transport of the same.

Accordingly, the light fitting of this invention is adapted for use with an incandescent lighting arrangement having a pair of incandescent bulbs and includes a containment member, a power cord member, a mounting bracket, a pair of socket members, a pair of insulated conductive cord members, and a lampshade body. The containment member includes an upper body and an annular portion. The upper body has a bottom wall provided with an anchoring area at a first center thereof, and formed with a communicating hole offset relative to the first center. The annular portion extends downwardly from the periphery that confines the bottom wall. The power cord member is adapted to be connected to a power source and is led downwardly and outwardly of the bottom wall of the upper body through the communicating hole and into the annular portion to form a first contact terminal. The mounting bracket includes an elongate middle portion that defines a mounting area for securing to the anchoring area and that has a bottom surface and a top wide surface, and first and second end portion which are disposed at opposite sides of the middle portion. The first and second end portion are bent respectively to an acute angle relative to and towards the bottom wide surface of the middle portion along two parallel lines which incline with a predetermined angle relative to a perpendicular line that crosses a longitudinal direction of the middle portion so as to form first and second anchoring surfaces, respectively. Each of the socket members has a shell portion adapted to receive the bulb base of a respective one of the incandescent bulbs and a seat portion which extends from the shell portion in an axial direction to abut against a respective one of the first and second anchoring surfaces, the axial direction being normal relative to the respective one of the anchoring surfaces. Each of the insulative conductive cord members has one end portion connected conductively to the seat portion of a respective one of the socket members, and the other end portion led to form a second contact terminal to couple electrically with the first contact terminal. The lampshade body is formed from molding plastics, and includes an upper wall and a skirt portion which extends downwardly and divergently from the periphery confining the upper wall. The upper wall has a second center and is of a dimension such that, when the upper wall is in a mounting position relative to the bottom wall of the upper body, the annular portion will shield the upper wall by superimposing upon the latter. The upper wall further defines a through opening to permit the mounting portion of the bracket member, which has the socket members abutting against the first and second anchoring surfaces, to extend downwardly and outwardly of the upper wall and into the skirt portion, and to have the mounting area of the bracket member aligned with the second center when the upper wall of the lampshade body is in the mounting position.

A plurality of the lampshade bodies can be stacked one over another after detachment from the respective one of the containment members to facilitate storage and transport of the same.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
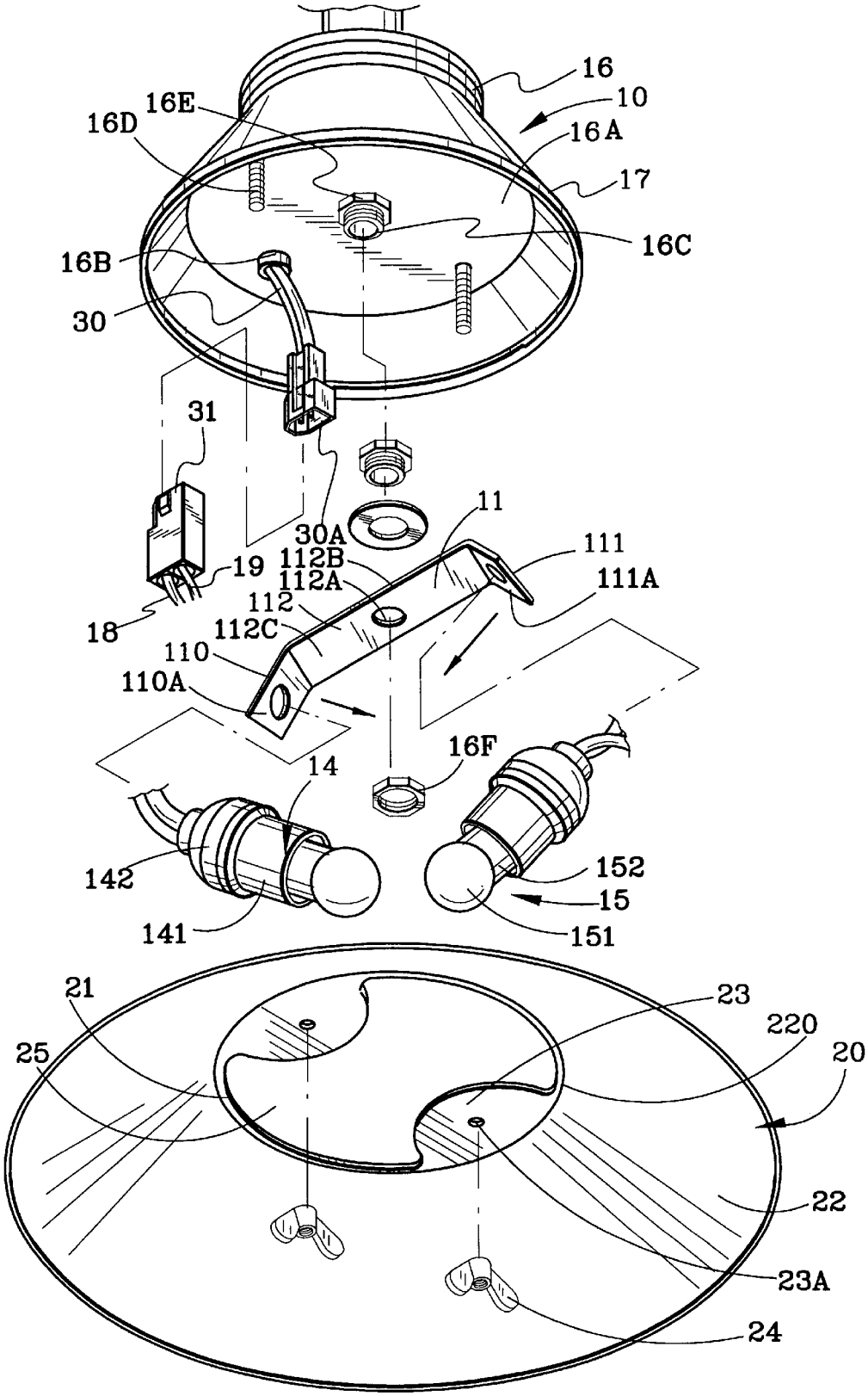
FIG. 1 is an exploded view of a preferred embodiment of a light fitting of this invention.

The light fitting of this invention is adapted for use with an incandescent lighting arrangement having a pair of incandescent bulbs 15, as shown in FIG. 1.

Figure 2:
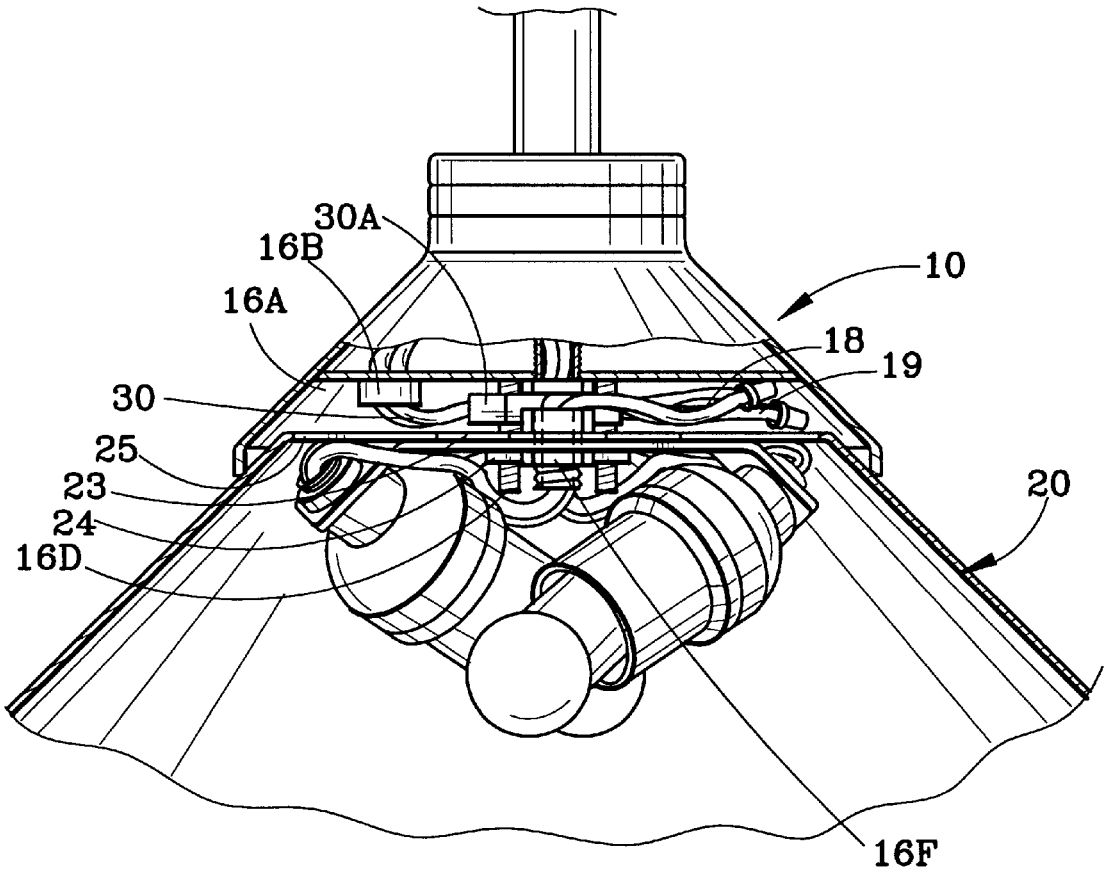
FIG. 2 is a partially cut away view of the preferred embodiment.

Referring to FIGS. 1 and 2, the preferred embodiment of a light fitting of this invention is shown to include a containment member 10, a power cord member 30, a mounting bracket 11, a pair of socket members 14, a pair of insulated conductive cord members 18, 19, and a lampshade body 20.

As illustrated, the containment member 10 includes an upper body 16 and an annular portion 17. The upper body 16 has a bottom wall 16A provided with an anchoring area at a first center 16C thereof, and formed with a communicating hole 16B offset relative to the first center 16C. The annular portion 17 extends downwardly from the periphery that confines the bottom wall 16A.

The power cord member 30 is adapted to be connected to a power source, and is led downwardly and outwardly of the bottom wall 16A of the upper body 16 through the communicating hole 16B and into the annular portion 17 to form a first contact terminal 30A.

The mounting bracket 11 includes an elongate middle portion 112 that defines a mounting area for securing to the anchoring area and that has a bottom wide surface 112C and a top wide surface 112B, and first and second end portions 110, 111 which are disposed at opposite sides of the middle portion 112. The first and second end portions 110, 111 are bent respectively to an acute angle relative to and towards the bottom wide surface 112C of the middle portion 112 along two parallel lines which incline with a predetermined angle relative to a perpendicular line that crosses a longitudinal direction of the middle portion 112 so as to form first and second anchoring surfaces 110A, 111A, respectively.

Each of the socket members 14 has a shell portion 141 adapted to receive the bulb base 152 of a respective one of the incandescent bulb 15 and a seat portion 142 which extends from the shell portion 141 in an axial direction to abut against a respective one of the first and second anchoring surfaces 110A, 111A, the axial direction being normal relative to the respective one of the anchoring surfaces 110A, 111A.

Each of the insulative conductive cord members 18, 19 has one end portion connected conductively to the seat portion 142 of a respective one of the socket members 14, and the other end portion led to form a second contact terminal 31 to couple electrically with the first contact terminal 30A.

The lampshade body 20 is formed from molding plastics, and includes an upper wall 21 and a skirt portion 22 which extends downwardly and divergently from the periphery 220 that confines the upper wall 21. The upper wall 21 has a second center and of a dimension such that, when the upper wall 21 is in a mounting position relative to the bottom wall 16A of the upper body 16, the annular portion 17 will shield the upper wall 21 by superimposing upon the latter. The upper wall 21 further defines a through opening 25 to permit the bracket member 11, which has the socket members 14 fixed on the first and second anchoring surfaces 110A, 11A, to extend downwardly and outwardly of the upper wall 21 and into the skirt portion 22. Under such a condition, the mounting area of the bracket member 11 is aligned with the second center of the upper wall 21 when the latter is in the mounting position.

In the preferred embodiment, the bottom wall 16A of the upper body 16 has a bracket mounting stud 16E at the first center 16C, and two downwardly extending mounting posts 16D offset to the first center 16C thereof. The bracket member 11 has a mounting hole 112A for extension of the stud 16E. A nut 16F is used to mount the bracket member 11 on the bottom wall 16A. The upper wall 21 of the lampshade body 20 has a lug portion consisting of two diametrically disposed lugs 23 that extend toward the second center such that the through opening 25 is narrowed at a middle portion thereof to permit exposure of the socket members 14 from two opposite sides of the opening 25 after attachment of the lampshade body 20 to the containment member 10 with the mounting posts 16D passing through the holes 23A of the lugs 23. Two nut units 24 are threaded to the mounting posts 16D for securing the lampshade body 20 on the containment member 10.

Note that the first and second anchoring surfaces 110A, 111A are provided with two through holes respectively for passage of the conductive cord members 18, 19 therethrough. Due to the inclined arrangement of the first and second anchoring surfaces 110A, 111A relative to the middle portion 112, the incandescent bulbs 15 mounted thereon cooperatively provide a lighting effect comparable to a halogen lamp which has the same wattage as that of the incandescent bulbs 15 having bulb body 151.

Figure 3:
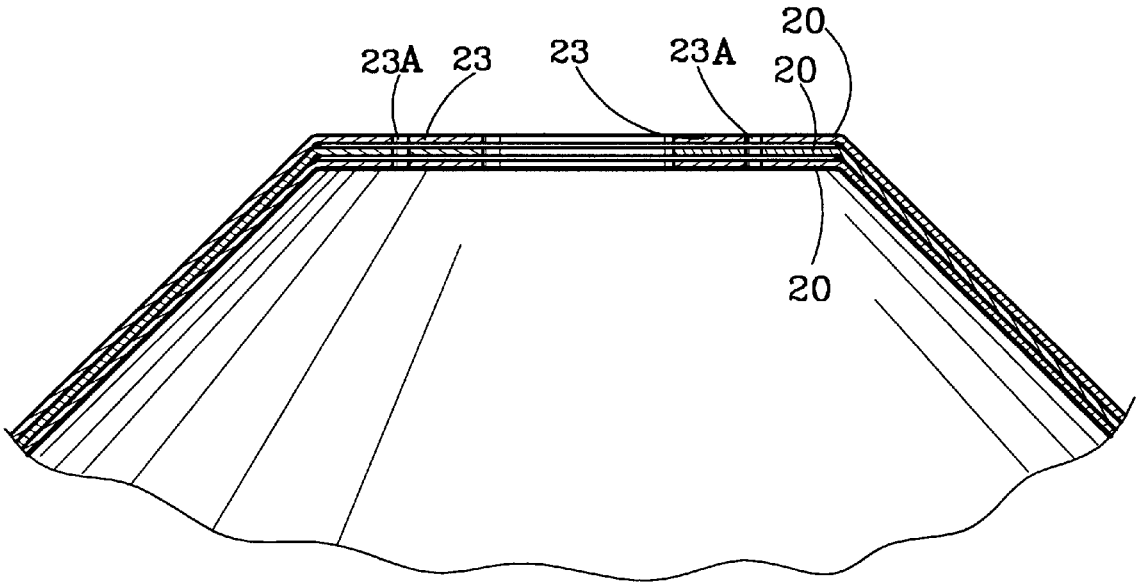
FIG. 3 illustrates how a plurality of lampshade bodies are stacked one over another for storage and transport.

As best shown in FIG. 3, a plurality of the lampshade bodies 20 can be stacked one over anther in order to facilitate in storage and transport of the same.

With this invention thus explained, it is apparent that numerous modifications and variations can be made without departing from the scope and spirit of this invention. It is therefore intended that this invention be limited only as indicated in the appended claims.

I claim:

1. A light fitting for an incandescent lighting arrangement having a pair of incandescent bulbs, each of which has a bulb body and a bulb base, said light fitting comprising:

a containment member for housing electrical components associated with electricity supply to the incandescent lighting arrangement, said containment member including:

an upper body having a bottom wall provided with an anchoring area at a first center thereof, and formed with a communicating hole offset from said first center; and an annular portion extending downwardly from a periphery confining said bottom wall;

a power cord member adapted to be connected to a power source and led downwardly and outwardly of said bottom wall through said communicating hole and into said annular portion to form a first contact terminal;

a mounting bracket including an elongate middle portion that defines a mounting area for securing to said anchoring area and that has a bottom wide surface and a top wide surface; and first and second end portions disposed at opposite sides of said middle portion, said first and second end portions being bent respectively to an acute angle relative to and towards said bottom wide surface of said middle portion along two parallel lines which incline with a predetermined angle relative to a perpendicular line crossing a longitudinal direction of said middle portion so as to form first and second anchoring surfaces, respectively;

a pair of socket members adapted to receive the incandescent bulbs, each having a shell portion adapted to receive the bulb base of a respective one of the incandescent bulbs, and a seat portion extending from said shell portion in an axial direction to abut against a respective one of said first and second anchoring surfaces, said axial direction being normal relative to a respective one of said anchoring surfaces;

a pair of insulated conductive cord members, each having one end portion connected conductively to said seat portion of a respective one of said socket members, and the other end portion led to form a second contact terminal to couple electrically with said first contact terminal; and a lampshade body formed from molding plastics, and including an upper wall and a skirt portion which extends downwardly and divergently from a periphery confining said upper wall, said upper wall having a second center and being of a dimension, such that, when said upper wall is in a mounting position relative to said bottom wall of said upper body, said annular portion will shield said upper wall by superimposing upon said upper wall, said upper wall further defining a through opening to permit said mounting bracket, which has said pair of socket members abutting against said first and second anchoring surfaces respectively, to extend downwardly and outwardly of said upper wall and into said skirt portion, and to have said mounting area of said bracket member aligned with said second center when said upper wall of said lampshade body is in said mounting position.

2. A light fitting according to claim 1, wherein said upper wall has a lug portion extending from the periphery thereof towards said second center to be mounted on said bottom wall in said mounting position.

3. A light fitting according to claim 2, wherein said lug portion includes two diametrically disposed lugs with through holes formed respectively therethrough.

4. A light fitting according to claim 3, wherein said bottom wall of said upper body has a bracket mounting stud at said first center for mounting of said bracket member, and two downwardly extending mounting posts offset to said first center for extension through said holes of said lugs for mounting of said lampshade body on said bottom wall.

* * * * *